US010930461B2

(12) United States Patent
Kim et al.

(10) Patent No.: US 10,930,461 B2
(45) Date of Patent: Feb. 23, 2021

(54) ELECTRONIC CIRCUIT BREAKER WITH LOCKOUT MECHANISM INTEGRATED INTO ELECTRONIC TRIP MECHANISM

(71) Applicant: Siemens Industry, Inc., Alpharetta, GA (US)

(72) Inventors: Raiden Jay Kim, Buford, GA (US); Guang Yang, Johns Creek, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 258 days.

(21) Appl. No.: 16/289,071

(22) Filed: Feb. 28, 2019

(65) Prior Publication Data

US 2020/0279710 A1 Sep. 3, 2020

(51) Int. Cl.
*H01H 71/50* (2006.01)
*H01H 71/24* (2006.01)

(52) U.S. Cl.
CPC ..... *H01H 71/505* (2013.01); *H01H 71/2454* (2013.01)

(58) Field of Classification Search
CPC ..... H01H 71/505; H01H 71/2454
USPC ..... 335/38
See application file for complete search history.

(56) References Cited

U.S. PATENT DOCUMENTS 4,301,434 A * 11/1981 Castonguay ..... H01H 83/12 200/400
6,172,584 B1 * 1/2001 Castonguay ..... H01H 71/505 335/172
7,098,761 B2 * 8/2006 Germain ..... H01H 83/04 335/18
2003/0080837 A1 * 5/2003 Macbeth ..... H02H 3/05 335/18

* cited by examiner

*Primary Examiner* — Alexander Talpalatski

(57) ABSTRACT

An electronic circuit breaker comprises an electronic circuitry and a lockout mechanism configured to provide a safety feature. The lockout mechanism includes a trip rod placed along a longitudinal axis of the electronic circuit breaker. The trip rod has first and second ends. The lockout mechanism further includes a barrel mounted coaxially around the trip rod near the first end of the trip rod. The lockout mechanism further includes a moving arm mechanically coupled to the trip rod. The lockout mechanism further includes an electronic-powered magnet mounted coaxially on the trip rod near the second end being opposite of the first end of the trip rod. The lockout mechanism further includes an armature mechanically coupled to the trip rod. The barrel serves to block the moving arm and the trip rod is pushed by the electronic-powered magnet to interact with the barrel to remove a lockout such that the electronic-powered magnet is activated to push the trip rod to pull on the armature, causing the electronic circuit breaker to be tripped.

20 Claims, 6 Drawing Sheets

ELECTRONIC CIRCUIT BREAKER WITH LOCKOUT MECHANISM INTEGRATED INTO ELECTRONIC TRIP MECHANISM

BACKGROUND

1. Field

Aspects of the present invention generally relate to an electronic circuit breaker with a lockout mechanism integrated into an electronic trip mechanism using a single electromagnet.

2. Description of the Related Art

Arc Fault Circuit Interrupter (AFCI) and Ground Fault Circuit Interrupter (GFCI) are types of electronic circuit breakers that provide electrical protection by using electronic components to detect and interrupt various kinds of faults in a circuit. If an electronic component is damaged or failed, the electronics may not work properly to provide the intended electrical protection. Therefore, a mechanism called lockout mechanism is often used in the circuit breaker industry to lock the breaker from being able to be turned on if there is a problem with electronics. Circuit breakers offering the lockout feature often must utilize three magnets—one for high electric current trip(disconnect) operation, another to electronically trip the breaker on fault detection, and lastly for the lockout mechanism. However, this is not an economical approach to build a lockout breaker, since it uses a lot of electromagnets, which are costly components in a circuit breaker.

As described above, a total of three electromagnets were used inside an electronic circuit breaker to achieve its regular functions of tripping (disconnecting circuit) and lockout. Incorporating a lockout mechanism inside a circuit breaker this way brings the margin down significantly. Usually, most electronic circuit breakers do not even have lockout mechanism, since it costs a lot of money and lockout mechanism is currently not a safety requirement. Instead, a bimetal is used in addition to electronics to provide an additional method of tripping. This is to ensure that the breaker can still trip even when electronics are damaged. In a traditional circuit breaker with a bimetal, the bimetal bends due to heat when an overload of current flows on it, and the bending functions as an automatic input to trip the circuit. However, use of such a bimetal is not the best solution.

Therefore, there is a need of a better lockout mechanism in an electronic circuit breaker.

SUMMARY

Briefly described, aspects of the present invention relate to an economical lockout mechanism for an electronic circuit breaker. The lockout mechanism is integrated into an electronic trip mechanism using a single electromagnet. The electronic circuit breaker offers a lockout feature utilizing total two magnets instead of three magnets. It is an economical approach to build a lockout electronic circuit breaker since it uses less electromagnets which are costly components in a circuit breaker.

In accordance with one illustrative embodiment of the present invention, an electronic circuit breaker comprises an electronic circuitry and a lockout mechanism configured to provide a safety feature in which the electronic circuit breaker is moved in a locked-out state so being locked from going into a turned ON state if the electronic circuitry inside the electronic circuit breaker is found not functional. The lockout mechanism includes a trip rod placed along a longitudinal axis of the electronic circuit breaker. The trip rod has first and second ends. The lockout mechanism further includes a barrel mounted coaxially around the trip rod near the first end of the trip rod. The lockout mechanism further includes a moving arm mechanically coupled to the trip rod. The lockout mechanism further includes an electronic-powered magnet mounted coaxially on the trip rod near the second end being opposite of the first end of the trip rod. The lockout mechanism further includes an armature mechanically coupled to the trip rod. The barrel serves to block the moving arm and the trip rod is pushed by the electronic-powered magnet to interact with the barrel to remove a lockout such that the electronic-powered magnet is activated to push the trip rod to pull on the armature, causing the electronic circuit breaker to be tripped.

In accordance with another illustrative embodiment of the present invention, an electronic circuit breaker comprises a lockout mechanism. The lockout mechanism includes a trip rod placed along a longitudinal axis of the electronic circuit breaker. The trip rod has first and second ends and a cylinder tab. The lockout mechanism further includes a barrel mounted coaxially around the trip rod near the first end of the trip rod. The barrel is a rotating component that includes a rotator tab, first and second stoppers on a side of the barrel, a lockout slot where the cylinder tab travels and a trip slot where the cylinder tab travels during a trip. The cylinder tab on the trip rod travels in the lockout slot and the trip slot of the barrel. The lockout mechanism further includes a moving arm mechanically coupled to the trip rod and configured to move to connect and disconnect a circuit. The moving arm includes a pusher tab and a lockout tab. The pusher tab on the moving arm pushes down the rotator tab on the barrel during a turn ON process so that the cylinder tab is sitting on the lockout slot. The lockout tab on the moving arm gets blocked by the first stopper and the second stopper on the barrel during the turn ON process. The first stopper locks out the electronic circuit breaker from turning ON by blocking the lockout tab. The second stopper stops the lockout tab until the barrel and the trip rod resets. The rotator tab on the barrel rotates the barrel when pushed by the pusher tab and wherein the lockout slot is a slot where the cylinder tab travels and as the cylinder tab travels the barrel rotates, and the first stopper moves out of way of the moving arm thus removing a lockout. The lockout mechanism further includes an electronic-powered magnet mounted coaxially on the trip rod near the second end being opposite of the first end of the trip rod. The electronic-powered magnet operates to push the trip rod to remove the lockout during the turn ON process and to trip the electronic circuit breaker when needed. The lockout mechanism further includes an electromagnet disposed near the first end of the trip rod. The electromagnet operates to push the trip rod to trip the electronic circuit breaker when needed. The lockout mechanism further includes a cradle that latches on the armature for the electronic circuit breaker to be able to turn ON and trips when the armature is rotated during a trip process. The lockout mechanism further includes an armature mechanically coupled to the trip rod. The armature latches on the cradle and lets go of the cradle during the trip process when the trip rod pushes to rotate the armature. The lockout mechanism is configured to provide a safety feature in which the electronic circuit breaker is moved in a locked-out state so being locked from going into a turned ON state if an electronic circuitry inside the electronic circuit breaker is found not functional.

In accordance with another illustrative embodiment of the present invention, a method of moving an electronic circuit breaker in a locked-out state so being locked from going into a turned ON state if an electronic circuitry inside the electronic circuit breaker is found not functional. The method comprises providing an electronic circuitry and providing a lockout mechanism configured to provide a safety feature like shown in claim 1.

DETAILED DESCRIPTION

To facilitate an understanding of embodiments, principles, and features of the present invention, they are explained hereinafter with reference to implementation in illustrative embodiments. In particular, they are described in the context of a lockout circuit breaker consisted of a lockout mechanism that is integrated into an electronic trip mechanism using a single electromagnet and a barrel. The lockout mechanism is used in the lockout circuit breaker to lock the breaker from being able to be turned ON if there is a problem with electronics. This is to ensure that the user cannot turn ON the breaker if the electronics are damaged. Lockout mechanism discussed in this invention provides a lockout feature utilizing only few components. Lockout is a safety feature in which an electronic circuit breaker is "locked" from being turned ON if electronics inside the breaker is not functional. The barrel serves to block a moving arm, and a trip rod is pushed by an electronic-powered magnet to interact with the barrel to remove a lockout. Both or either magnets can be activated to push the trip rod to pull on an armature, causing the breaker to be tripped. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
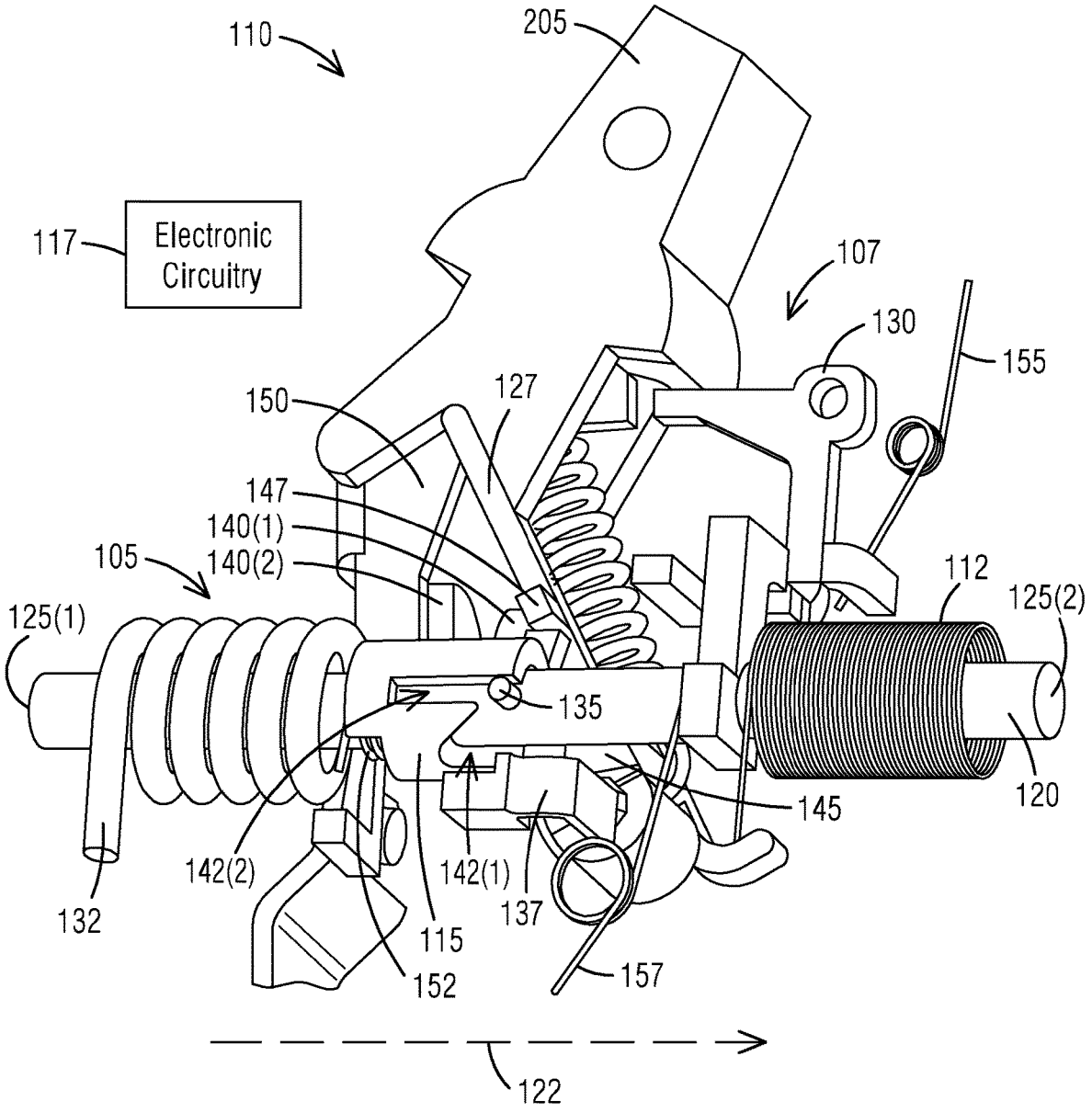
FIG. 1 illustrates a diagrammatic view of a lockout mechanism integrated into an electronic trip mechanism of an electronic circuit breaker using a single electromagnet with a barrel that is shown at an OFF position in accordance with an exemplary embodiment of the present invention.

Consistent with one embodiment of the present invention, FIG. 1 represents a representation of a diagrammatic view of a lockout mechanism 105 integrated into an electronic trip mechanism 107 of an electronic circuit breaker 110 using a single electromagnet such as an electronic-powered magnet 112 with a barrel 115 that is shown at an OFF position in accordance with an exemplary embodiment of the present invention. The electronic circuit breaker 110 further comprises an electronic circuitry 117. The lockout mechanism 105 is configured to provide a safety feature in which the electronic circuit breaker 110 is moved in a locked-out state so being locked from going into a turned ON state if the electronic circuitry 117 inside the electronic circuit breaker 110 is found not functional.

In one embodiment, the lockout mechanism 105 includes a trip rod 120 placed along a longitudinal axis 122 of the electronic circuit breaker 110. The trip rod 120 has first and second ends 125(1, 2). The lockout mechanism 105 further includes the barrel 115 mounted coaxially around the trip rod 120 near the first end 125(1) of the trip rod 120. The lockout mechanism 105 further includes a moving arm 127 mechanically coupled to the trip rod 120. The lockout mechanism 105 further includes the electronic-powered magnet 112 mounted coaxially on the trip rod 120 near the second end 125(2) being opposite of the first end 125(1) of the trip rod 120. The lockout mechanism 105 further includes an armature 130 mechanically coupled to the trip rod 120. The barrel 115 serves to block the moving arm 127 and the trip rod 120 is pushed by the electronic-powered magnet 112 to interact with the barrel 115 to remove a lockout such that the electronic-powered magnet 112 is activated to push the trip rod 120 to pull on the armature 130, causing the electronic circuit breaker 110 to be tripped.

In the electronic circuit breaker 110, when the moving arm 127 is rotated to turn ON the electronic circuit breaker 110, the moving arm 127 is configured to push down on the barrel 115 to rotate the same and then gets blocked by the barrel 115 a first time such that the electronic circuit breaker 110 is put into the locked-out state. The electronic circuitry 117 is configured to run a self-test such that after the self-test the electronic-powered magnet 112 pushes the trip rod 120 which in turn rotates the barrel 115 further and when the barrel 115 is rotated the moving arm 127 passes through and gets stopped by the barrel 115 for a second time. When the electronic-powered magnet 112 stops firing, the barrel 115 and the trip rod 120 reset to their original positions and the moving arm 127 travels fully to close a circuit of the electronic circuit breaker 110. The electronic circuit breaker 110 further comprises an electromagnet 132 disposed near the first end 125(1) of the trip rod 120 such that when tripping either or both the electromagnet 132 and the electronic-powered magnet 112 push the trip rod 120 to left, pulling on the armature 130 in process to trip the electronic circuit breaker 110 and the trip rod 120 travels inside the barrel 115 and when the electromagnet 132 and the electronic-powered magnet 112 stops firing the trip rod 120 resets to its original position.

The lockout mechanism 105 of the electronic circuit breaker 110 includes the trip rod 120 that has a cylinder tab 135. The barrel 115 is a rotating component that includes a rotator tab 137, first and second stoppers 140(1, 2) on a side of the barrel 115, a lockout slot 142(1) where the cylinder tab 135 travels and a trip slot 142(2) where the cylinder tab 135 travels during a trip. The cylinder tab 135 on the trip rod 120 travels in the lockout slot 142(1) and the trip slot 142(2) of the barrel 115. The trip slot 142(2) is configured for a trip operation and the lockout slot 142(1) is configured to unlock the electronic circuit breaker 110.

The moving arm 127 is configured to move to connect and disconnect a circuit. The moving arm 127 includes a pusher tab 145 (see also FIG. 4) and a lockout tab 147. The pusher tab 145 on the moving arm 127 pushes down the rotator tab 137 on the barrel 115 during a turn ON process so that the cylinder tab 135 is sitting on the lockout slot 142(1). The lockout tab 147 on the moving arm 127 gets blocked by the first stopper 140(1) and the second stopper 140(2) on the barrel 115 during the turn ON process. The first stopper 140(1) locks out the electronic circuit breaker 110 from turning ON by blocking the lockout tab 147. The second stopper 140(2) stops the lockout tab 147 until the barrel 115 and the trip rod 120 resets. The rotator tab 137 on the barrel 115 rotates the barrel 115 when pushed by the pusher tab 145 and wherein the lockout slot 142(1) is a slot where the cylinder tab 135 travels and as the cylinder tab 135 travels the barrel 115 rotates and the first stopper 140(1) moves out of way of the moving arm 127 thus removing a lockout.

The lockout mechanism 105 of the electronic circuit breaker 110 further includes the electronic-powered magnet 112 that operates to push the trip rod 120 to remove the lockout during the turn ON process and to trip the electronic circuit breaker 110 when needed. The lockout mechanism 105 of the electronic circuit breaker 110 further includes the electromagnet 132 that operates to push the trip rod 120 to trip the electronic circuit breaker 110 when needed.

The lockout mechanism 105 of the electronic circuit breaker 110 further includes a cradle 150 that latches on the armature 130 for the electronic circuit breaker to be able to turn ON and trips when the armature 130 is rotated during a trip process. The lockout mechanism 105 of the electronic circuit breaker 110 further includes the armature 130 that latches on the cradle 150 and lets go of the cradle 150 during the trip process when the trip rod 120 pushes to rotate the armature 130.

The electronic circuit breaker 110 further comprises a barrel reset spring 152 configured to reset the barrel 115 during the turn ON process when the moving arm 127 is stopped at the second stopper 140(2). The electronic circuit breaker 110 further comprises an armature reset spring 155 configured to reset the armature 130. The electronic circuit breaker 110 further comprises a trip rod reset spring 157 configured to reset the trip rod 120 during the turn ON process when the moving arm 127 is stopped at the second stopper 140(2) and after the electronic circuit breaker 110 is tripped.

A breaker operating mechanism with the lockout mechanism 105 is shown in FIG. 1 through FIG. 5. One key difference between a regular circuit breaker and the lockout circuit breaker 110 is the existence of a component named the barrel 115. FIG. 1 shows a lockout breaker assembly with the barrel 115 at an OFF position. There are two slots 142 on the barrel 115. The trip slot 142(2) (a straight slot) serves for a trip operation and the lockout slot 142(1) (a curved slot) serves to unlock the electronic circuit breaker 110. When the cylinder tab 135 on the trip rod 120 is sitting on the straight slot of the barrel 115 and is pulled by the electromagnet 112 and/or 132 to the left, the trip rod 120 is pulled the full extent and pulls the armature 130 to trip the electronic circuit breaker 110. However, when the cylinder tab 135 is on the curved slot and the trip rod 120 is pulled, the barrel 115 is rotated as the cylinder tab 135 travels inside the curve slot, and the armature 130 is not pulled, since that slot is shorter than the trip slot 142(2).

Figure 2:
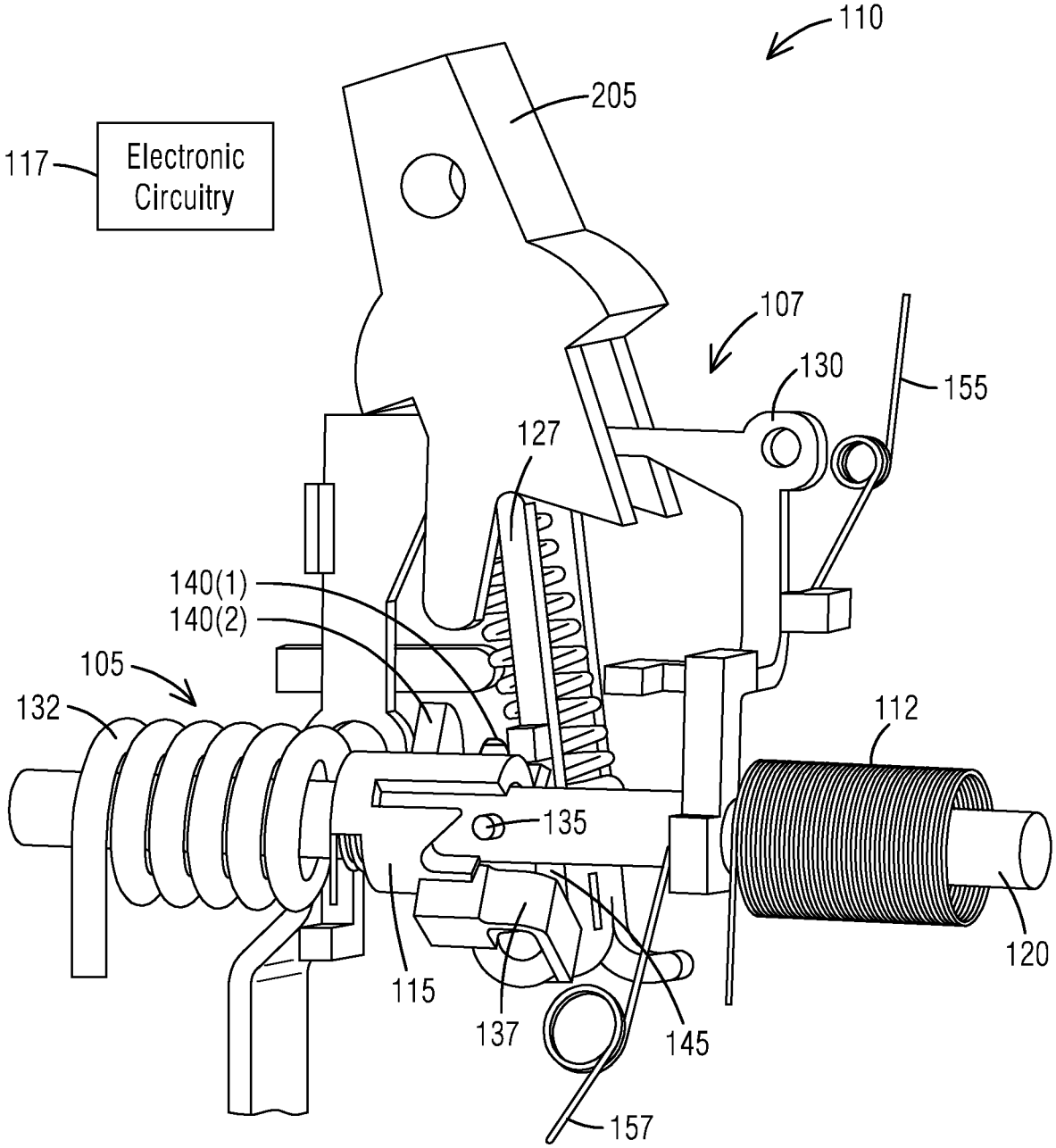
FIG. 2 illustrates the first step of turning ON for the electronic circuit breaker in accordance with an exemplary embodiment of the present invention.

Referring to FIG. 2, it illustrates the first step of turning ON for the electronic circuit breaker 110 in accordance with an exemplary embodiment of the present invention. As a handle 205 is rotated counterclockwise, the moving arm 127 rotates clockwise. As the moving arm 127 is rotating, it not only moves towards left in the FIG. 2, but it also moves down vertically a bit, since it is drawing an arc as it rotates. When the moving arm 127 moves down, the pusher tab 145 on the moving arm 127 pushes the rotator tab 137 on the barrel 115 and rotates the barrel 115. This achieves two functions: firstly, the rotated barrel's 115 first stopper 140(1) is now blocking the moving arm 127 from going further to the left, preventing it from turning ON and secondly, the cylinder tab 135 on the trip rod 120 is sitting at the entrance of the lockout slot 142(1) (the curved slot).

Figure 3:
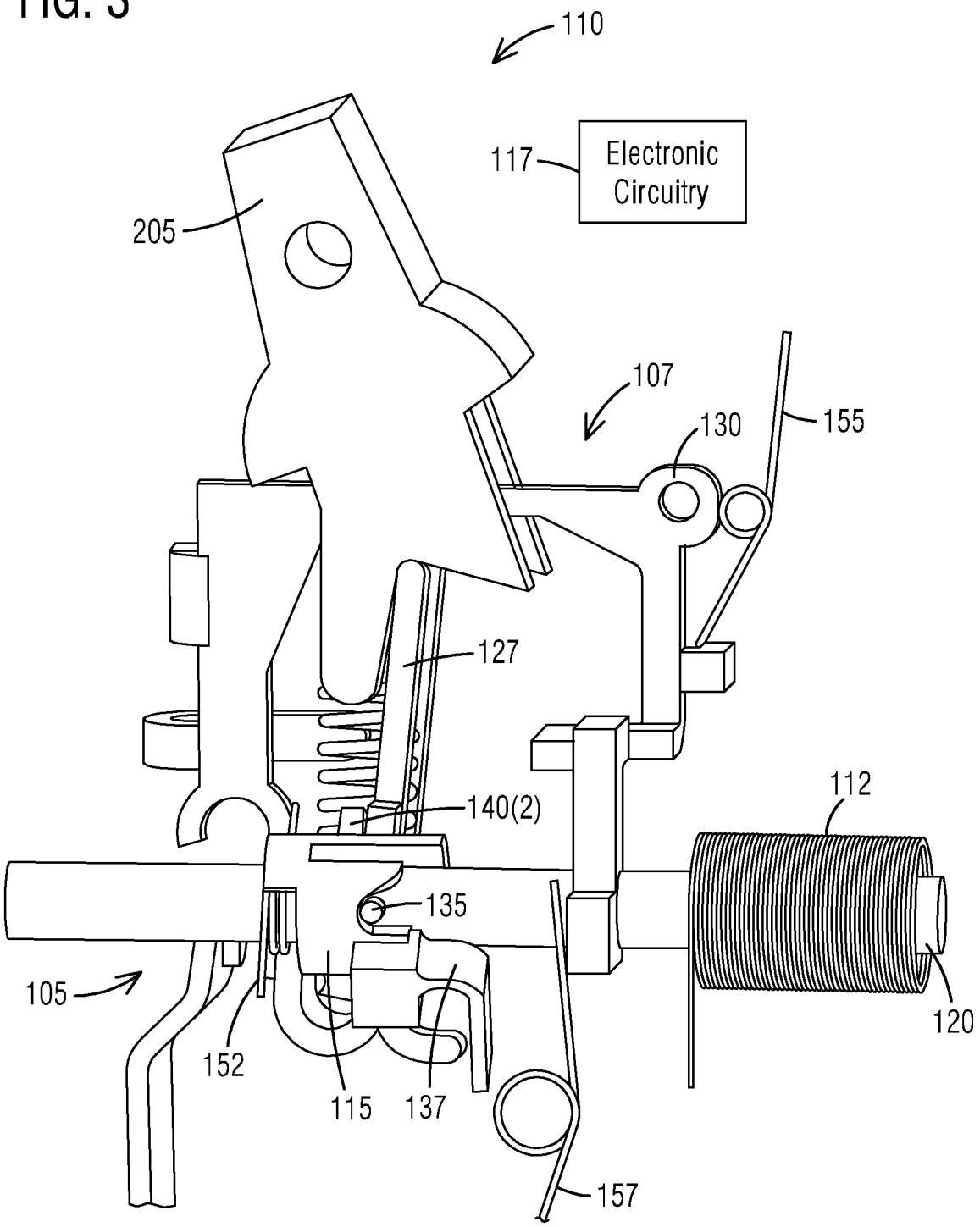
FIG. 3 illustrates an unlocking process in accordance with an exemplary embodiment of the present invention.

Turning now to FIG. 3, it illustrates an unlocking process in accordance with an exemplary embodiment of the present invention. In the unlocking process, if the electronic circuitry 117 pass a self-test and signals the electromagnet 112 to pull the trip rod 120, the cylinder tab 135 travels on a curved path, rotating the barrel 115 to move the first stopper 140(1) out of the way of the moving arm 127. The moving arm 127 then falls further to the left, now being stopped by the second stopper 140(2).

Figure 4:
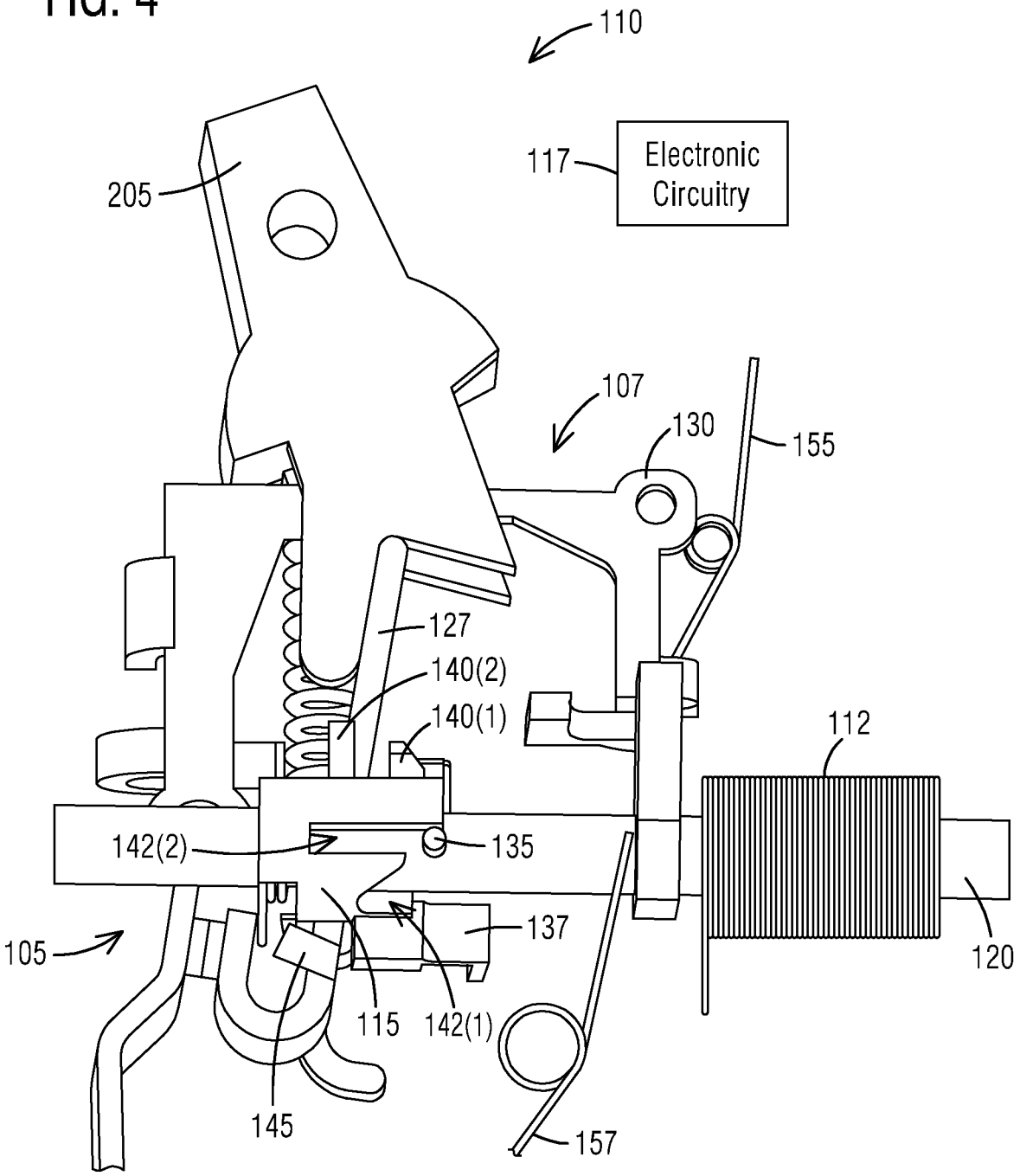
FIG. 4 illustrates the final step of turning ON in accordance with an exemplary embodiment of the present invention.

FIG. 4 illustrates the final step of turning ON in accordance with an exemplary embodiment of the present invention. After the electromagnet 112 stops pulling the trip rod 120, the trip rod reset spring 157 pushes the trip rod 120 back to its original position. The barrel reset spring 152 rotates the barrel 115 to its original position, and this moves the second stopper 140(2) out of the way of the moving arm 127, allowing it to make the circuit. The purpose of the second stopper 140(2) is to not allow the moving arm 127 to make an electrical connection before the barrel 115 and the trip rod 120 are reset. Without the second stopper 140(2), if a short circuit occurs at the instant of making the circuit, the trip rod 120 may still be sitting in the lockout slot 142(1) (the curved slot), and the electronic circuit breaker 110 would not be able to be tripped.

Figure 5:
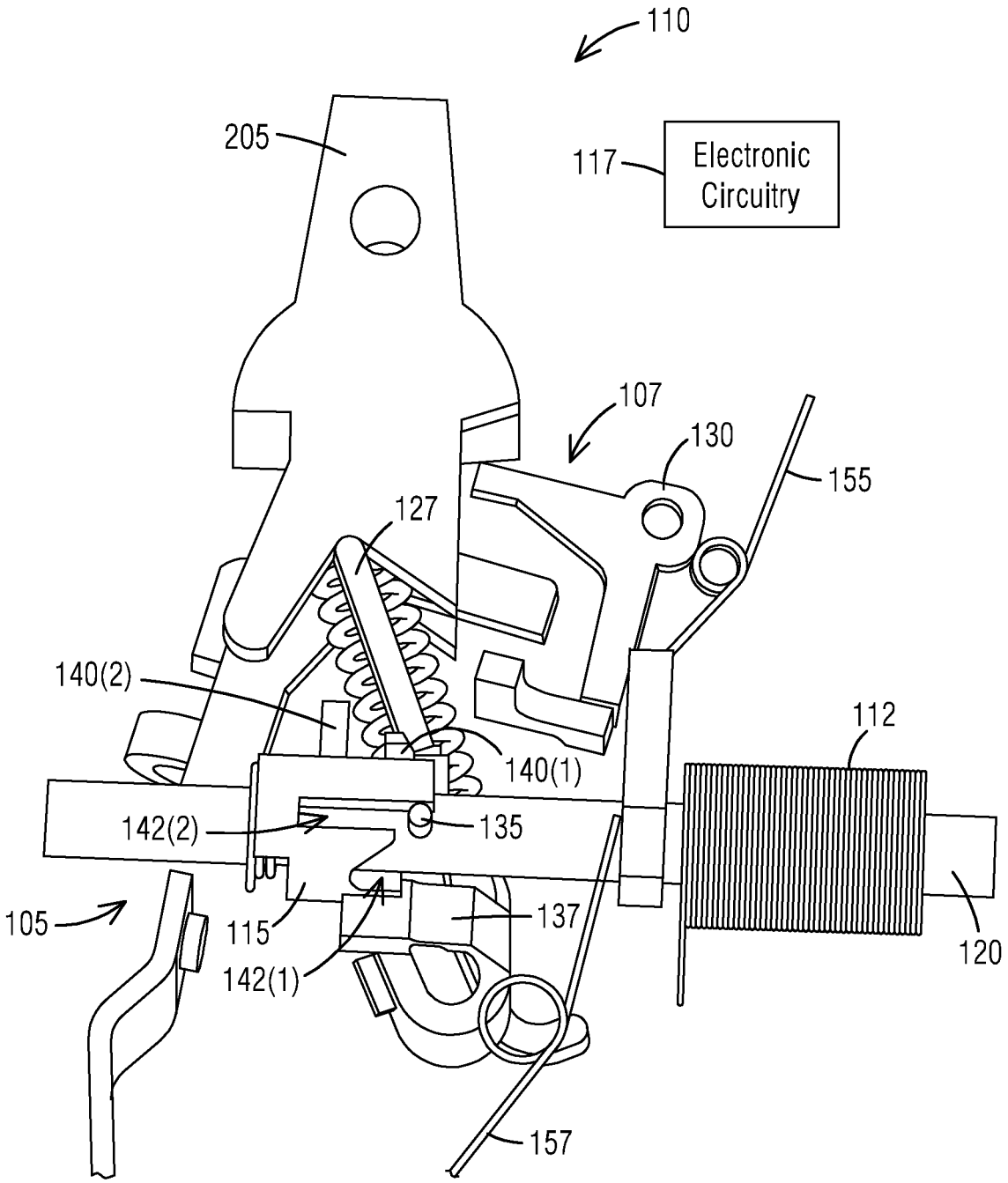
FIG. 5 illustrates a TRIP operation for the electronic circuit breaker in accordance with an exemplary embodiment of the present invention.

As seen in FIG. 5, it illustrates a TRIP operation for the electronic circuit breaker 110 in accordance with an exemplary embodiment of the present invention. At an ON position, the electromagnet 112 and/or 132 pulls the trip rod 120, and the trip rod 120 travels in the trip slot 142(2) to pull the armature 130. Then, a similar TRIP process as a regular circuit breaker occurs to open the circuit. The one difference in TRIP process from the regular circuit breaker is that the pusher tab 145 (see FIG. 4) on the moving arm 127 hits the rotator tab 137 on the barrel 115 as it travels right.

However, the rotator tab 137 works like a leaf spring, stretching to the right to make way for the moving arm 127. The trip rod reset spring 157 pushes the trip rod 120 back to its original position when the TRIP process is done. The tripped lockout circuit breaker 110 can be reset the same way as the tripped regular circuit breaker to be able to turn the breaker ON again. When the electronic circuit breaker 110 is reset from TRIP to OFF, the rotator tab 137 goes back to its original shape. Turning the lockout circuit breaker 110 from ON to OFF follows the same process as the regular circuit breaker.

Figure 6:
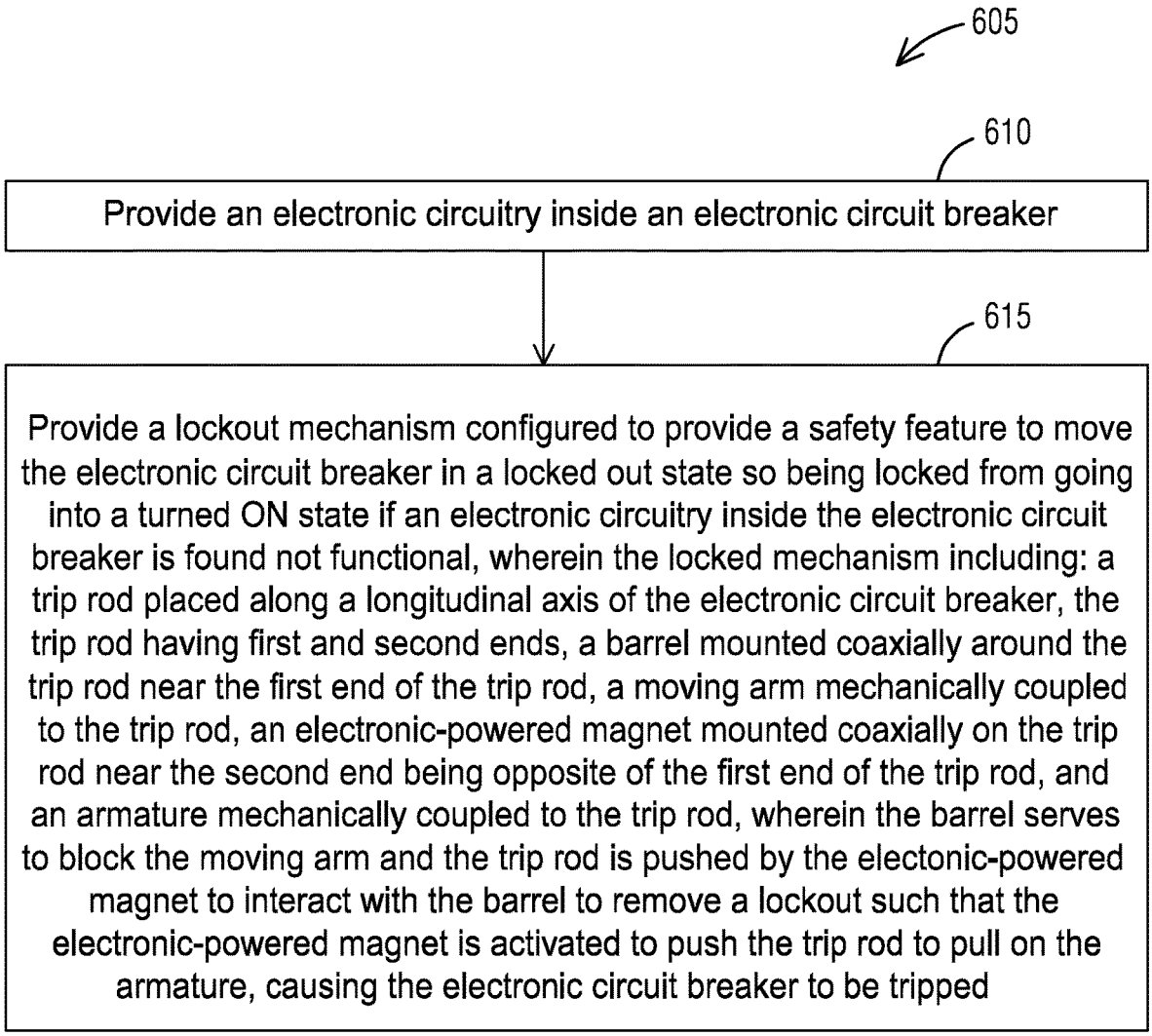
FIG. 6 illustrates a schematic view of a flow chart of a method of moving an electronic circuit breaker in a locked-out state so being locked from going into a turned ON state if an electronic circuitry inside the electronic circuit breaker is found not functional in accordance with an exemplary embodiment of the present invention.

As shown in FIG. 6, it illustrates a schematic view of a flow chart of a method 605 of moving the electronic circuit breaker 110 in a locked-out state so being locked from going into a turned ON state if the electronic circuitry 117 inside the electronic circuit breaker 110 is found not functional in accordance with an exemplary embodiment of the present invention. Reference is made to the elements and features described in FIGS. 1-5. It should be appreciated that some steps are not required to be performed in any particular order, and that some steps are optional.

The method 605 comprises a step 610 of providing the electronic circuitry 117 inside of the electronic circuit breaker 110. The method 605 comprises a step 615 of providing the lockout mechanism 105 of FIG. 1 configured to provide a safety feature. The electronic circuit breaker 110 has the lockout mechanism 105 integrated into an electronic trip mechanism using a single electromagnet.

While a barrel-based design of an electronic circuit breaker is described here a range of one or more other types of lockout mechanisms or other forms of lockout mechanisms are also contemplated by the present invention. For example, other types of lockout mechanisms may be implemented based on one or more features presented above without deviating from the spirit of the present invention.

The techniques described herein can be particularly useful for Arc Fault Circuit Interrupter (AFCI) and Ground Fault Circuit Interrupter (GFCI) types of electronic circuit breakers. While particular embodiments are described in terms of the AFCI and GFCI electronic circuit breakers, the techniques described herein are not limited to the AFCI and GFCI electronic circuit breakers but can also be used with other electronic circuit breakers.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An electronic circuit breaker comprising:

an electronic circuitry; and a lockout mechanism configured to provide a safety feature in which the electronic circuit breaker is moved in a locked-out state so being locked from going into a turned ON state if the electronic circuitry inside the electronic circuit breaker is found not functional, wherein the lockout mechanism including:

a trip rod placed along a longitudinal axis of the electronic circuit breaker, the trip rod having first and second ends, a barrel mounted coaxially around the trip rod near the first end of the trip rod, a moving arm mechanically coupled to the trip rod, an electronic-powered magnet mounted coaxially on the trip rod near the second end being opposite of the first end of the trip rod, and an armature mechanically coupled to the trip rod, wherein the barrel serves to block the moving arm and the trip rod is pushed by the electronic-powered magnet to interact with the barrel to remove a lockout such that the electronic-powered magnet is activated to push the trip rod to pull on the armature, causing the electronic circuit breaker to be tripped.

2. The electronic circuit breaker of claim 1, wherein when the moving arm is rotated to turn ON the electronic circuit breaker, the moving arm is configured to push down on the barrel to rotate the same and then gets blocked by the barrel a first time such that the electronic circuit breaker is put into the locked-out state.

3. The electronic circuit breaker of claim 1, wherein the electronic circuitry is configured to run a self-test such that after the self-test the electronic-powered magnet pushes the trip rod which in turn rotates the barrel further and when the barrel is rotated the moving arm passes through and gets stopped by the barrel for a second time.

4. The electronic circuit breaker of claim 3, wherein when the electronic-powered magnet stops firing, the barrel and the trip rod reset to their original positions and the moving arm travels fully to close a circuit of the electronic circuit breaker.

5. The electronic circuit breaker of claim 4, further comprising:

an electromagnet disposed near the first end of the trip rod such that when tripping either or both the electromagnet and the electronic-powered magnet push the trip rod to left, pulling on the armature in process to trip the electronic circuit breaker and the trip rod travels inside the barrel and when the electromagnet and the electronic-powered magnet stops firing the trip rod resets to its original position.

6. An electronic circuit breaker comprising:

a lockout mechanism including:

a trip rod placed along a longitudinal axis of the electronic circuit breaker, the trip rod having first and second ends and a cylinder tab;

a barrel mounted coaxially around the trip rod near the first end of the trip rod, wherein the barrel is a rotating component that includes a rotator tab, first and second stoppers on a side of the barrel, a lockout slot where the cylinder tab travels and a trip slot where the cylinder tab travels during a trip, wherein the cylinder tab on the trip rod travels in the lockout slot and the trip slot of the barrel;

a moving arm mechanically coupled to the trip rod and configured to move to connect and disconnect a circuit, wherein the moving arm including a pusher tab and a lockout tab, wherein the pusher tab on the moving arm pushes down the rotator tab on the barrel during a turn ON process so that the cylinder tab is sitting on the lockout slot, wherein the lockout tab on the moving arm gets blocked by the first stopper and the second stopper on the barrel during the turn ON process, wherein the first stopper locks out the electronic circuit breaker from turning ON by blocking the lockout tab, wherein the second stopper stops the lockout tab until the barrel and the trip rod resets, wherein the rotator tab on the barrel rotates the barrel when pushed by the pusher tab and wherein the lockout slot is a slot where the cylinder tab travels and as the cylinder tab travels the barrel rotates and the first stopper moves out of way of the moving arm thus removing a lockout;

an electronic-powered magnet mounted coaxially on the trip rod near the second end being opposite of the first end of the trip rod, wherein the electronic-powered magnet operates to push the trip rod to remove the lockout during the turn ON process and to trip the electronic circuit breaker when needed;

an electromagnet disposed near the first end of the trip rod, wherein the electromagnet operates to push the trip rod to trip the electronic circuit breaker when needed;

a cradle that latches on the armature for the electronic circuit breaker to be able to turn ON and trips when the armature is rotated during a trip process; and an armature mechanically coupled to the trip rod, wherein the armature latches on the cradle and let's go of the cradle during the trip process when the trip rod pushes to rotate the armature, wherein the lockout mechanism is configured to provide a safety feature in which the electronic circuit breaker is moved in a locked-out state so being locked from going into a turned ON state if an electronic circuitry inside the electronic circuit breaker is found not functional.

7. The electronic circuit breaker of claim 6, wherein the barrel serves to block the moving arm and the trip rod is pushed by the electronic-powered magnet to interact with the barrel to remove a lockout such that the electronic-powered magnet is activated to push the trip rod to pull on the armature, causing the electronic circuit breaker to be tripped.

8. The electronic circuit breaker of claim 6, wherein when the moving arm is rotated to turn ON the electronic circuit breaker, the moving arm is configured to push down on the barrel to rotate the same and then gets blocked by the barrel a first time such that the electronic circuit breaker is put into the locked-out state.

9. The electronic circuit breaker of claim 6, wherein the electronic circuitry is configured to run a self-test such that after the self-test the electronic-powered magnet pushes the trip rod which in turn rotates the barrel further and when the barrel is rotated the moving arm passes through and gets stopped by the barrel for a second time.

10. The electronic circuit breaker of claim 9, wherein when the electronic-powered magnet stops firing, the barrel and the trip rod reset to their original positions and the moving arm travels fully to close a circuit of the electronic circuit breaker.

11. The electronic circuit breaker of claim 10, wherein when tripping either or both the electromagnet and the electronic-powered magnet push the trip rod to left, pulling on the armature in process to trip the electronic circuit breaker and the trip rod travels inside the barrel and when the electromagnet and the electronic-powered magnet stops firing the trip rod resets to its original position.

12. The electronic circuit breaker of claim 6, further comprising:

a barrel reset spring configured to reset the barrel during the turn ON process when the moving arm is stopped at the second stopper.

13. The electronic circuit breaker of claim 6, further comprising:

an armature reset spring configured to reset the armature.

14. The electronic circuit breaker of claim 6, further comprising:

a trip rod reset spring configured to reset the trip rod during the turn ON process when the moving arm is stopped at the second stopper and after the electronic circuit breaker is tripped.

15. The electronic circuit breaker of claim 6, wherein the trip slot is configured for a trip operation and the lockout slot is configured to unlock the electronic circuit breaker.

16. A method of moving an electronic circuit breaker in a locked-out state so being locked from going into a turned ON state if an electronic circuitry inside the electronic circuit breaker is found not functional, the method comprising:

providing an electronic circuitry; and providing a lockout mechanism configured to provide a safety feature, wherein the lockout mechanism including:

a trip rod placed along a longitudinal axis of the electronic circuit breaker, the trip rod having first and second ends, a barrel mounted coaxially around the trip rod near the first end of the trip rod, a moving arm mechanically coupled to the trip rod, an electronic-powered magnet mounted coaxially on the trip rod near the second end being opposite of the first end of the trip rod, and an armature mechanically coupled to the trip rod, wherein the barrel serves to block the moving arm and the trip rod is pushed by the electronic-powered magnet to interact with the barrel to remove a lockout such that the electronic-powered magnet is activated to push the trip rod to pull on the armature, causing the electronic circuit breaker to be tripped.

17. The method of claim 16, wherein when the moving arm is rotated to turn ON the electronic circuit breaker, the moving arm is configured to push down on the barrel to rotate the same and then gets blocked by the barrel a first time such that the electronic circuit breaker is put into the locked-out state.

18. The method of claim 16, wherein the electronic circuitry is configured to run a self-test such that after the self-test the electronic-powered magnet pushes the trip rod which in turn rotates the barrel further and when the barrel is rotated the moving arm passes through and gets stopped by the barrel for a second time.

19. The method of claim 18, wherein when the electronic-powered magnet stops firing, the barrel and the trip rod reset to their original positions and the moving arm travels fully to close a circuit of the electronic circuit breaker.

20. The method of claim 19, further comprising:

providing an electromagnet disposed near the first end of the trip rod such that when tripping either or both the electromagnet and the electronic-powered magnet push the trip rod to left, pulling on the armature in process to trip the electronic circuit breaker and the trip rod travels inside the barrel and when the electromagnet and the electronic-powered magnet stops firing the trip rod resets to its original position.

* * * * *